US012090417B2

(12) United States Patent
Feng et al.

(10) Patent No.: US 12,090,417 B2
(45) Date of Patent: Sep. 17, 2024

(54) REMOTE-CONTROL AIRCRAFT

(71) Applicant: HANGZHOU ZT MODEL CO., LTD., Hangzhou (CN)

(72) Inventors: Rui Feng, Hangzhou (CN); Xianjun Wu, Hangzhou (CN); He Jiang, Hangzhou (CN); Qingsong Qiu, Hangzhou (CN)

(73) Assignee: HANGZHOU ZT MODEL CO., LTD., Hangzhou (CN)

( * ) Notice: Subject to any disclaimer, the term of this patent is extended or adjusted under 35 U.S.C. 154(b) by 192 days.

(21) Appl. No.: 17/730,730

(22) Filed: Apr. 27, 2022

(65) Prior Publication Data

US 2023/0211245 A1 Jul. 6, 2023

(30) Foreign Application Priority Data

Dec. 31, 2021 (CN) ..... 202111666369.2

(51) Int. Cl.
*A63H 27/00* (2006.01)
*A63H 30/04* (2006.01)

(52) U.S. Cl.
CPC ..... *A63H 27/02* (2013.01); *A63H 27/001* (2013.01); *A63H 30/04* (2013.01)

(58) Field of Classification Search
CPC .... A63H 27/02; A63H 27/001; A63H 33/067; A63H 31/10
See application file for complete search history.

(56) References Cited

U.S. PATENT DOCUMENTS 2,161,971 A * 6/1939 Heinrich ..... A63H 17/38 446/454
3,304,526 A * 2/1967 Adams ..... A63H 30/04 335/272

(Continued)

FOREIGN PATENT DOCUMENTS

DE 102008023194 A1 * 12/2009 ..... A63H 27/02
DE 102008061752 A1 * 6/2010 ..... A63H 27/001

(Continued)

OTHER PUBLICATIONS

Translation DE102008023194A1 (Year: 2009).*
Translation KR20170127791A (Year: 2017).*
Translation WO2009111916A1 (Year: 2009).*

*Primary Examiner* — Eugene L Kim
*Assistant Examiner* — Alyssa M Hylinski
(74) *Attorney, Agent, or Firm* — Ziegler IP Law Group LLC.

(57) ABSTRACT

A remote-control aircraft comprises an aircraft body with a mounting platform provided with a connecting part and first magnet(s), and the connecting part is perforated with a connecting hole; and comprises an aircraft wing with an inserting part and second magnet(s) on its underside close to the aircraft body, the inserting part is rotationally inserted into the connecting hole, the second magnet and the first magnet are connected by magnetic attraction, and the aircraft wing is in close contact with the mounting platform. Thus, the aircraft wing and body can be quickly assembled and disassembled and can be carried conveniently. While the aircraft wing collides with an obstacle, it can be rotated around the inserting part as the center, and the impact force can be unloaded by rotating to prevent the aircraft wing from being damaged and prevent the aircraft wing from being separated from the aircraft body.

8 Claims, 8 Drawing Sheets

(56) References Cited

U.S. PATENT DOCUMENTS

| | | | | | |
|---|---|---|---|---|---|
| 3,557,488 | A * | 1/1971 | Nielsen | A63H 27/00 | 446/165 |
| 3,827,181 | A * | 8/1974 | Mabuchi | A63H 27/02 | 446/57 |
| 5,061,217 | A * | 10/1991 | Miller | A63H 27/00 | 446/61 |
| 6,183,331 | B1 * | 2/2001 | Lai | A63H 27/02 | 24/DIG. 59 |
| 6,726,148 | B2 * | 4/2004 | Carroll | B64U 30/12 | 206/335 |
| 2008/0194170 | A1 * | 8/2008 | Feng | A63H 27/02 | 446/34 |
| 2011/0130066 | A1 * | 6/2011 | Amireh | A63H 29/22 | 446/34 |

FOREIGN PATENT DOCUMENTS

| | | | | | |
|---|---|---|---|---|---|
| KR | 20170127791 | A * | 11/2017 | | |
| WO | WO-2004045735 | A1 * | 6/2004 | A63H 27/02 | |
| WO | WO-2009111916 | A1 * | 9/2009 | A63H 27/02 | |
| WO | WO-2010114387 | A1 * | 10/2010 | A63H 27/12 | |

* cited by examiner

REMOTE-CONTROL AIRCRAFT

CROSS REFERENCE TO RELATED APPLICATIONS

This patent application claims the benefit and priority of Chinese Patent Application No. 2021116663692 filed on Dec. 31, 2021, the disclosure of which is incorporated by reference herein in its entirety as part of the present application.

TECHNICAL FIELD

The present disclosure relates to the technical field of remote-control aircrafts, and in particular, to a remote-control aircraft.

BACKGROUND

With the improvement of the quality of life, there are more and more model toys owned by young people, and remote-control aircrafts are particularly popular among young people. However, most of the existing remote-control aircraft are integrally formed, and some parts of the aircraft cannot be replaced after damage, resulting in the scrapping of the entire remote-control aircraft. Furthermore, the current aircraft wing and body are fixed by adhesive connecting and cannot be disassembled, which makes the aircraft inconvenient to be carried and also makes the aircraft wing easily to be damaged due to impact.

SUMMARY

Embodiments of the present disclosure provide a remote-control aircraft, which has advantages of split molding, non-easily damaging of the aircraft wing, good applicability, etc.

Detailed technical solutions are as follows:

The embodiments of the present disclosure provide a remote-control aircraft, comprising: an aircraft body provided with a mounting platform, in which the mounting platform is provided with a connecting part and at least one first magnet, and the connecting part is perforated with a connecting hole; and an aircraft wing provided with an inserting part and at least one second magnet on a lower side of the aircraft wing close to the aircraft body, in which the inserting part is rotationally inserted into the connecting hole, the second magnet and the first magnet are connected by magnetic attraction, and the aircraft wing is d in close contact with the mounting platform.

In some embodiments, the inserting part comprises a mounting plate and two inserting connectors, and one end of each inserting connector is fixedly connected to the mounting plate; and, the mounting plate is fixedly connected to the aircraft wing, the two inserting connectors are arranged at intervals, and side surfaces of the two inserting connectors away from each other are both arc surfaces.

In some embodiments, the side surfaces of the two inserting connectors away from each other are respectively provided with buckles, each buckle extends along the circumferential direction of the corresponding inserting connector, and the diameter between the two buckles is larger than the diameter of the connecting hole.

In some embodiments, the buckles along with the inserting connectors pass through the connecting hole, and the buckles and the connecting part are arranged with certain space after installation.

In some embodiments, both an upper surface and a lower surface of each buckle are arc surfaces.

In some embodiments, the number of the first magnet is two or more, and three of the first magnets and the other three of the first magnets are arranged symmetrically with respect to the center line of the aircraft body; and, the number of the second magnet is two or more, and each second magnet is arranged in a one-to-one correspondence with the first magnet.

In some embodiments, four of the first magnets are arranged on the mounting platform close to an aircraft nose, and the other two of the first magnets are arranged on the mounting platform close to an aircraft tail.

In some embodiments, the remote-control aircraft further comprises a rear wing which is fixed on a tail of the aircraft body by adhesive connection.

In some embodiments, the remote-control aircraft further comprises a buffer bracket, an axle and a tail wheel, in which the buffer bracket is fixedly arranged on a lower side of the tail of the aircraft body, a through groove is provided on the buffer bracket, the axle includes a first rod and a second rod connected at an angle, one end of the first rod passes through the through groove to be connected with the rear wing, and one end of the second rod away from the first rod is rotationally connected with the tail wheel.

In some embodiments, the rear wing comprises a tail connecting rod, the aircraft body further comprises a steering gear connecting rod, and the remote control aircraft further comprises a silicone hose, in which the cooperating ends of the tail connecting rod and the steering gear connecting rod are both inserted into the silicone hose and fixedly connected by interference fit.

The present disclosure achieves the following beneficial effects:

in the present disclosure, the remote-control aircraft comprises an aircraft body with a mounting platform which is provided with a connecting part and at least one first magnet, and the connecting part is perforated with a connecting hole; and the remote-control aircraft also comprises an aircraft wing provided with an inserting part and at least one second magnet on the underside of the aircraft wing close to the aircraft body, the inserting part is rotationally inserted into the connecting hole, the second magnet and the first magnet are connected by magnetic attraction, and the airplane wing is in close contact with the mounting platform. Thus, the aircraft wing and the aircraft body can be quickly assembled and disassembled through the connection between the first magnet and the second magnet, and also can be carried conveniently. While the aircraft wing collides with an obstacle, the aircraft wing can be rotated around the inserting part as the center through the connection between the connecting part and the inserting part, that is, the impact force can be unloaded by rotating, so as to prevent the aircraft wing from being damaged due to the collision.

BRIEF DESCRIPTION OF THE DRAWINGS

The accompanying drawings described here are provided for further understanding of the present disclosure, and constitute a part of the present disclosure. The exemplary embodiments of the present disclosure and illustrations thereof are intended to explain the present disclosure, but do not constitute inappropriate limitations to the present disclosure. In the drawings.

Figure 1:
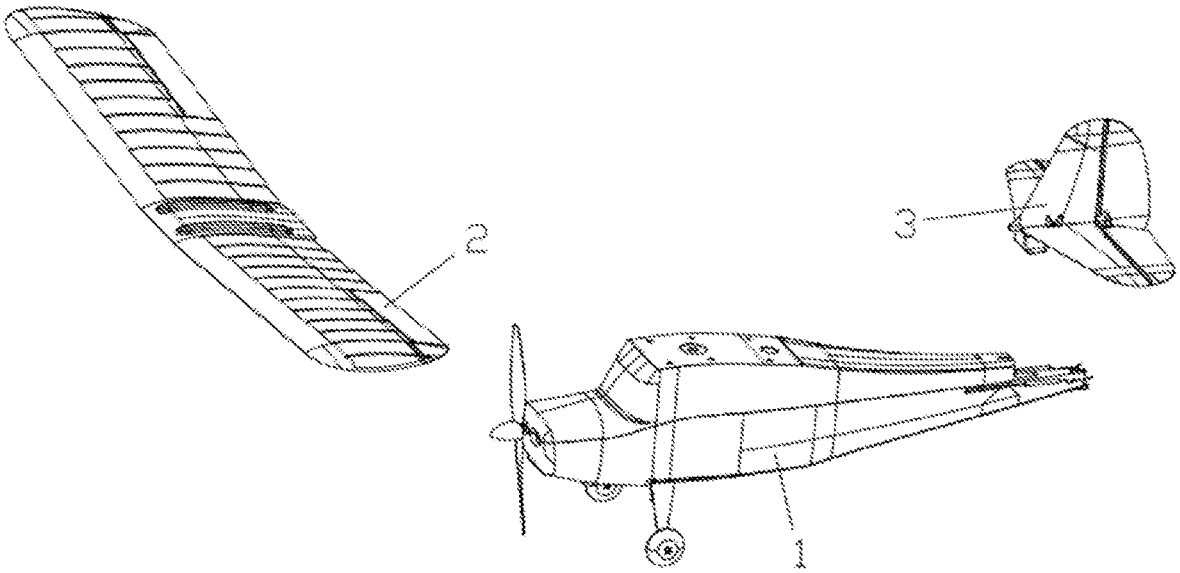
FIG. 1 is an exploded diagram of a remote-control aircraft according to an embodiment of the present disclosure.

Reference numerals: 1. aircraft body; 11. mounting platform; 12. connecting part; 13. first magnet(s); 14. connecting hole; 15. steering gear connecting rod; 16. limit slot; 2. aircraft wing; 21. inserting part; 211. mounting plate; 212. inserting connector(s); 22. second magnet(s); 23. buckle(s); 24. limit block; 25. adhesive connector; 3. rear wing; 31. tail connecting rod; 4. buffer bracket; 41. through groove; 51. axle; 52. tail wheel; 6. silicone hose.

DETAILED DESCRIPTION

To make the objectives, technical solutions, and advantages of the present disclosure clearer, the present disclosure is described below with reference to the accompanying drawings and embodiments. It should be understood that the embodiments described herein are merely used to explain the present disclosure, rather than to limit the present disclosure. All other embodiments obtained by those of ordinary skill in the art based on the embodiments of the present disclosure without creative efforts should fall within the protection scope of the present disclosure.

Apparently, the accompanying drawings in the following description show merely some embodiments of the present disclosure, and a person of ordinary skill in the art may apply the present disclosure to other similar scenarios according to these drawings without creative efforts. In addition, it can also be appreciated that, although it may take enduring and complex efforts to achieve such a development process, for those of ordinary skill in the art related to the present disclosure, some changes such as design, manufacturing or production made based on the technical content in the present disclosure are merely regular technical means, and should not be construed as insufficiency of the present disclosure.

The "embodiment" mentioned in the present disclosure means that a specific feature, structure, or characteristic described in combination with the embodiment may be included in at least one embodiment of the present disclosure. The phrase appearing in different parts of the specification does not necessarily refer to the same embodiment or an independent or alternative embodiment exclusive of other embodiments. It may be explicitly or implicitly appreciated by those of ordinary skill in the art that the embodiment described herein may be combined with other embodiments as long as no conflict occurs.

Unless otherwise defined, the technical or scientific terms used in the present disclosure are as they are usually understood by those of ordinary skill in the art to which the present disclosure pertains. The terms "one", "a", "the" and similar words are not meant to be limiting, and may represent a singular form or a plural form. The terms "include", "contain", "have" and any other variants in the present disclosure mean to cover the non-exclusive inclusion, for example, a process, method, system, product, or device that includes a series of steps or modules (units) is not necessarily limited to those steps or units which are clearly listed, but may include other steps or units which are not expressly listed or inherent to such a process, method, system, product, or device. "Connected", "interconnected", "coupled" and similar words in the present disclosure are not restricted to physical or mechanical connections, but may include electrical connections, whether direct or indirect. The term "multiple" in the present disclosure means two or more. The term "and/or" describes associations between associated objects, and it indicates three types of relationships. For example, "A and/or B" may indicate that A exists alone, A and B coexist, or B exists alone. The character "I" generally indicates that the associated objects are in an "or" relationship. The terms "first", "second", "third" and so on in the present disclosure are intended to distinguish between similar objects but do not necessarily indicate a specific order of the objects.

Referring to FIG. 1, an embodiment of the present disclosure provides a remote-control aircraft comprising an aircraft body 1, an aircraft wing 2, a rear wing 3, a buffer bracket 4, an axle 51, a tail wheel 52 and a silicone hose 6.

In this embodiment, the aircraft body 1 is provided with a mounting platform 11. The mounting platform 11 is provided with a connecting part 12 and at least one first magnet 13, and the connecting part 12 is perforated with a connecting hole 14. The aircraft wing 2 is provided with an inserting part 21 and at least one second magnet 22 on a lower side of the aircraft wing 2 close to the aircraft body 1, the inserting part 21 is rotationally inserted into the connecting hole 14, the second magnet 22 and the first magnet 13 are connected by magnetic attraction, and the aircraft wing 2 is in close contact with and the mounting platform 11.

Figure 2:
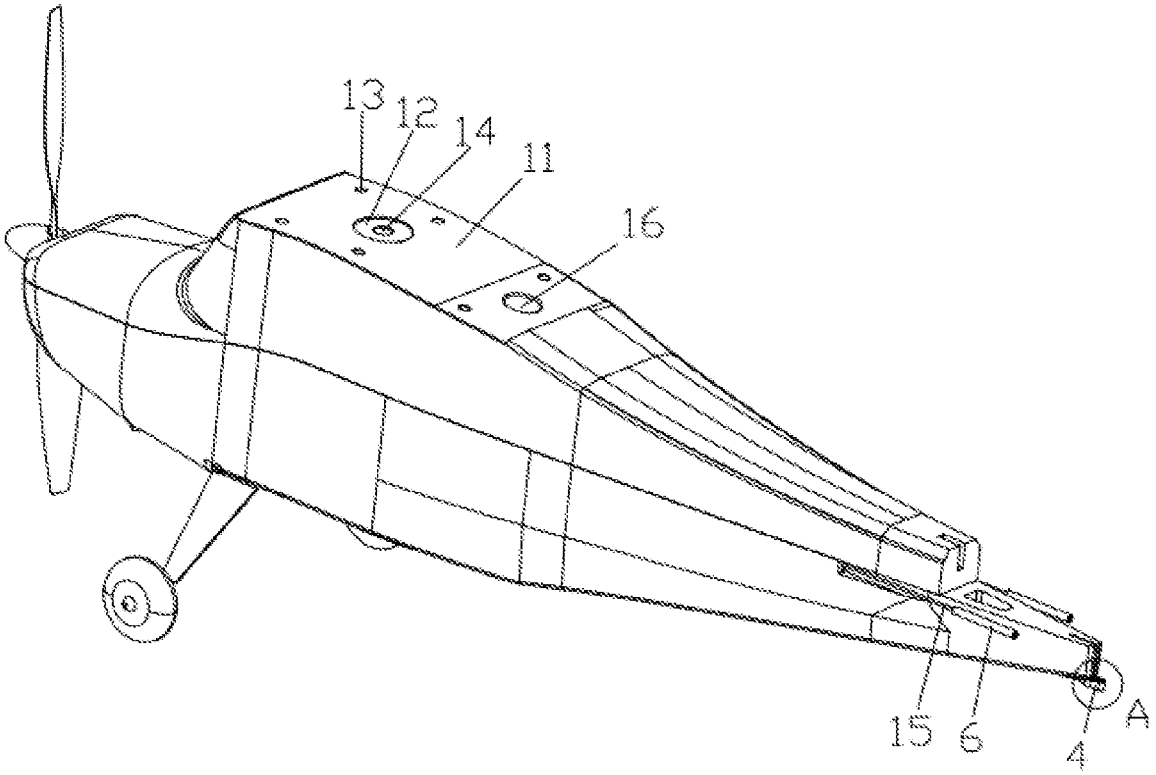
FIG. 2 is an assembly diagram of an aircraft body, a buffer bracket and a silicone hose according to an embodiment of the present disclosure.

Referring to FIG. 2, the mounting platform 11 is located on an upper surface of the aircraft body 1 close to the aircraft wing 2, and the mounting platform 11 is provided with the connecting part 12 which is perforated with the connecting hole 14. Since the interior of the aircraft body 1 is hollow, the connecting hole 14 is spatially connected with the interior space of aircraft body 1.

It should be noted that, the connecting part 12 is in a shape of circle, the connecting hole 14 is arranged at a position slightly deviated from the center of the connecting part 12, and the connecting hole 14 is located on the connecting part 12 close to an aircraft nose of the aircraft body 1. The position of the connecting hole 14 can make the rotation force of the aircraft wing 2 stronger after colliding with an obstacle, so as to prevent the aircraft wing 2 from being separated from the aircraft body 1.

In some preferred embodiments, the number of the first magnet 13 is two or more. Particularly, the number of the first magnet 13 is six. All the six first magnets 13 are arranged at intervals. Specifically, three of the first magnets 13 and the other three of the first magnets 13 are arranged symmetrically with respect to the center line of the aircraft body 1, in which four of the first magnets 13 are arranged on the mounting platform 11 close to the aircraft nose at four corners, and the other two of the first magnets 13 are arranged on the mounting platform 11 close to an aircraft tail.

Figure 4:
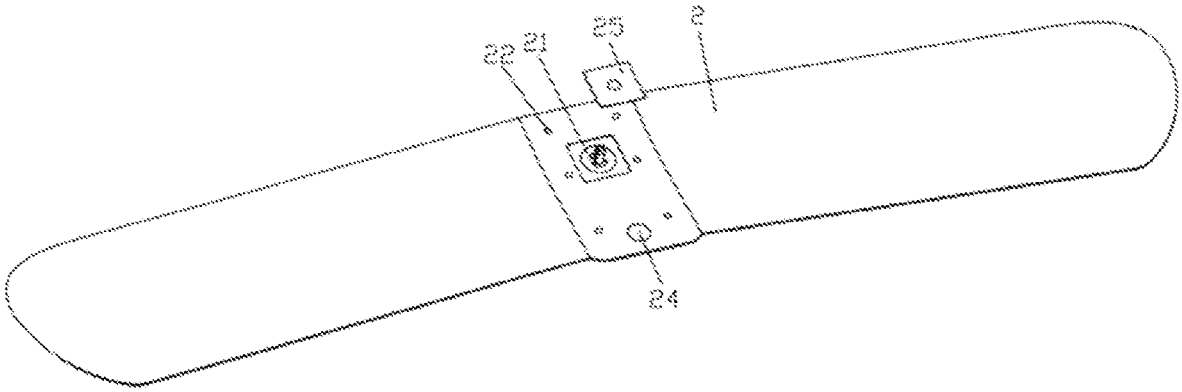
FIG. 4 is a schematic diagram of an aircraft wing according to an embodiment of the present disclosure.
Figure 5:
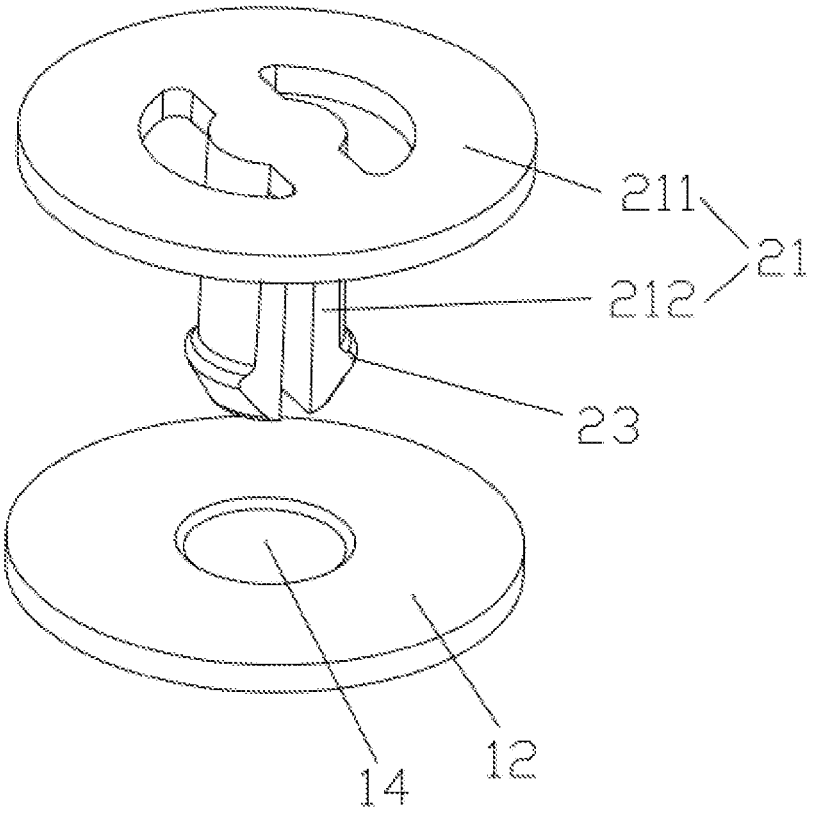
FIG. 5 is a schematic diagram of a connecting part and an inserting part according to an embodiment of the present disclosure.
Figure 6:
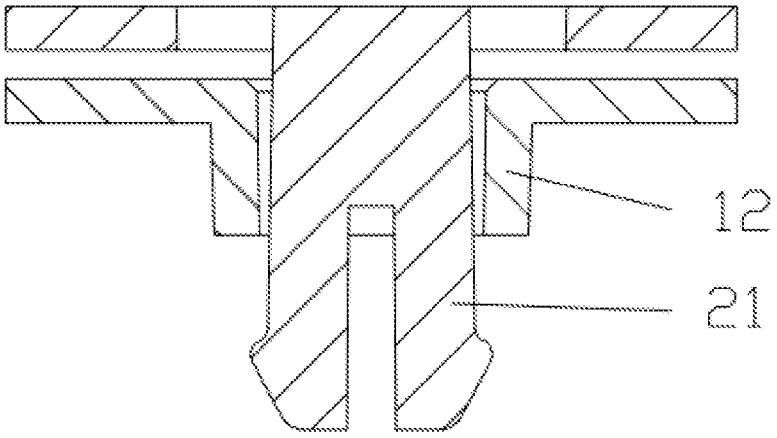
FIG. 6 is a cross-sectional diagram of a connecting part and an inserting part according to an embodiment of the present disclosure.

Referring to FIG. 4, FIG. 5 and FIG. 6, the inserting part 21 is provided on the lower side of the aircraft wing 2 close to aircraft body 1, and the location of the inserting part 21 is arranged corresponding to the location of the connecting part 12. Specifically, the inserting part 21 comprises a mounting plate 211 and inserting connector(s) 212. The mounting plate 211 can be, but not limited to, in a shape of a circle or a square. The mounting plate 211 can be fixedly connected to the aircraft wing 2 by various ways such as adhesive connecting, snap-in connecting, and fastener connecting.

In order to further strengthen the connection strength between the inserting part 21 and the aircraft wing 2, an adhesive connector 25 is pasted on the mounting plate 211 and is also bonded to the aircraft wing 2, to prevent the insertion part 21 from falling off the aircraft wing 2 when the aircraft wing 2 is repeatedly assembled and disassembled. The adhesive connector 25 is preferably a reinforcing sheet.

One end of the inserting connector 212 is fixedly connected to the mounting plate 211, and the inserting connector 212 and the mounting plate 211 are preferably integrally formed, while the other end of the inserting connector 212 extends toward the connecting part 12. Specifically, there are two inserting connectors 212 arranged at intervals and side surfaces of the two inserting connectors 212 away from each other are both arc surfaces. The diameter between the two inserting connectors 212 is equal to or smaller than the diameter of the connecting hole 14, and the length of the inserting connectors 212 is larger than the length of the connecting hole 14.

When the aircraft wing 2 needs to be fixedly connected to the aircraft body 1, the two inserting connectors 212 are rotationally inserted into the connecting hole 14, so that the aircraft wing 2 can rotate around the inserting connectors 212 as the center. The arc surfaces of the two inserting connectors 212 away from each other can also facilitate their rotation in the connecting hole 14. During the flight of the remote-control aircraft, when the aircraft wing 2 is impacted, the rotating aircraft wing 2 does not directly collide with obstacle, and the impact force can be unloaded by rotating to reduce the impact force on the aircraft wing 2, thereby reducing the damage of the aircraft wing 2 caused by the impact and also preventing the aircraft wing 2 and the aircraft body 1 from being detached or separated from each other, in order to ensure the normal use of the aircraft.

In order to prevent the inserting connectors 212 from falling off the connecting hole 14, an outer side surface of each inserting connector 212, which is close to the end of the connecting hole 14, is provided with a buckle 23. Each buckle 23 extends along the circumferential direction of the corresponding inserting connector 212. It should be noted that the diameter between the two buckles 23 is larger than the diameter of the connecting hole 14.

During the inserting connectors 212 inserting into the connecting hole 14, an outer surface of each buckle 23 firstly abuts against an inner surface of the connecting hole 14, then an extruding force between the buckles 23 and the inner surface of the connecting hole 14 will force the two inserting connectors 212 to approach each other due to the interval arrangement of the two inserting connectors 212, thereby the diameter between the two buckles 23 is reduced until the buckles 23 along with the inserting connectors 212 pass through the connecting hole 14 and enter into the interior of the aircraft body 1. After the buckles 23 entering into the interior of the aircraft body 1, the upper surfaces of the buckles 23 do not abut with the lower surface of the connecting hole 14, thus the buckles 23 are not subject to the extruding force so that the relative location of the inserting connectors 212 can be reset. Since the diameter between the two buckles 23 is larger than the diameter of the connecting hole 14, the buckles 23 can prevent the inserting connectors 212 from falling off the connecting hole 14, thereby further strengthening the connection strength between the aircraft wing 2 and the aircraft body 1.

Since the aircraft wing 2 and the aircraft body 1 are rotationally connected by the inserting part 21 and the connecting part 12, in which the rotation can be achieved by a user inserting or pulling out the inserting connector 212 from the connecting hole 14, the disassembly and assembly of the aircraft wing 2 and the aircraft body 1 and the carrying of the remote-control aircraft are all extremely convenient.

In order to save the effort of inserting or pulling out the inserting connectors 212 from the connecting hole 14, both the upper and lower side surfaces of each buckle 23 are arc surfaces. Smooth arc surfaces can reduce the friction force between the buckles 23 and the connecting hole 14, and then can achieve the effect of labor saving.

It should be noted that, in order to facilitate the rotation of the inserting connectors 212 in the connecting hole 14, the upper surfaces of the buckles 23 and the lower surface of the connecting hole 14 are arranged with certain space to prevent the rotation from being affected by the contact friction between the buckles 23 and the connecting part 12. In addition, since the aircraft wing 2 and the aircraft body 1 are rotationally connected, when the aircraft wing 2 collides with an obstacle, the impact force can be unloaded by rotating of the aircraft wing 2, thereby the probability of the aircraft body 1 being separated from the aircraft wing 2 can be significantly reduced, which is beneficial for the aircraft to continue flying.

In order to facilitate the installation and localization of the aircraft wing 2 and the aircraft body 1, the installation platform 11 is further provided with a limit slot 16, and the aircraft wing 2 is also provided with a limit block 24 protruding from the surface of the aircraft body 1. The limiting block 24 can be inserted into the limiting slot 16 to have the function of positioning.

In some preferred embodiments, there are two or more second magnets 22 provided on the lower side of the aircraft wing 2 close to the aircraft body 1. Particularly, the number of the second magnets 22 is six, and each second magnet 22 is arranged in a one-to-one correspondence with the first magnet 13. When the aircraft wing 2 needs to be connected to the aircraft body 1, the first magnets 13 and the second magnets 22 in correspondence with each other are connected by magnetic attraction, so as to prevent the rotation between the aircraft wing 2 and the aircraft body 1 during flying and ensure the normal flight of the remote-control aircraft. When the aircraft wing 2 collides with an obstacle, and the impact force is greater than the attraction force between the first magnets 13 and the second magnets 22, the aircraft wing 2 rotates, thereby the damage to the aircraft wing 2 is reduced. Furthermore, when the impact force on the aircraft wing 2 is not too greater than the attraction force between the first magnets 13 and the second magnets 22, the aircraft wing 2 can be reset to its original relative position by the attraction force between the first magnets 13 and the second magnets 22.

More specifically, when the remote-control aircraft takes off or flies, since the side of the aircraft wing 2 close to the aircraft nose will receive a larger lift, four of the first magnets 13 and four of the second magnets 22 are arranged close to the aircraft nose to provide a larger attraction force so as to prevent the aircraft wing 2 from rotating during takeoff or flight of the remote-control aircraft.

Figure 7:
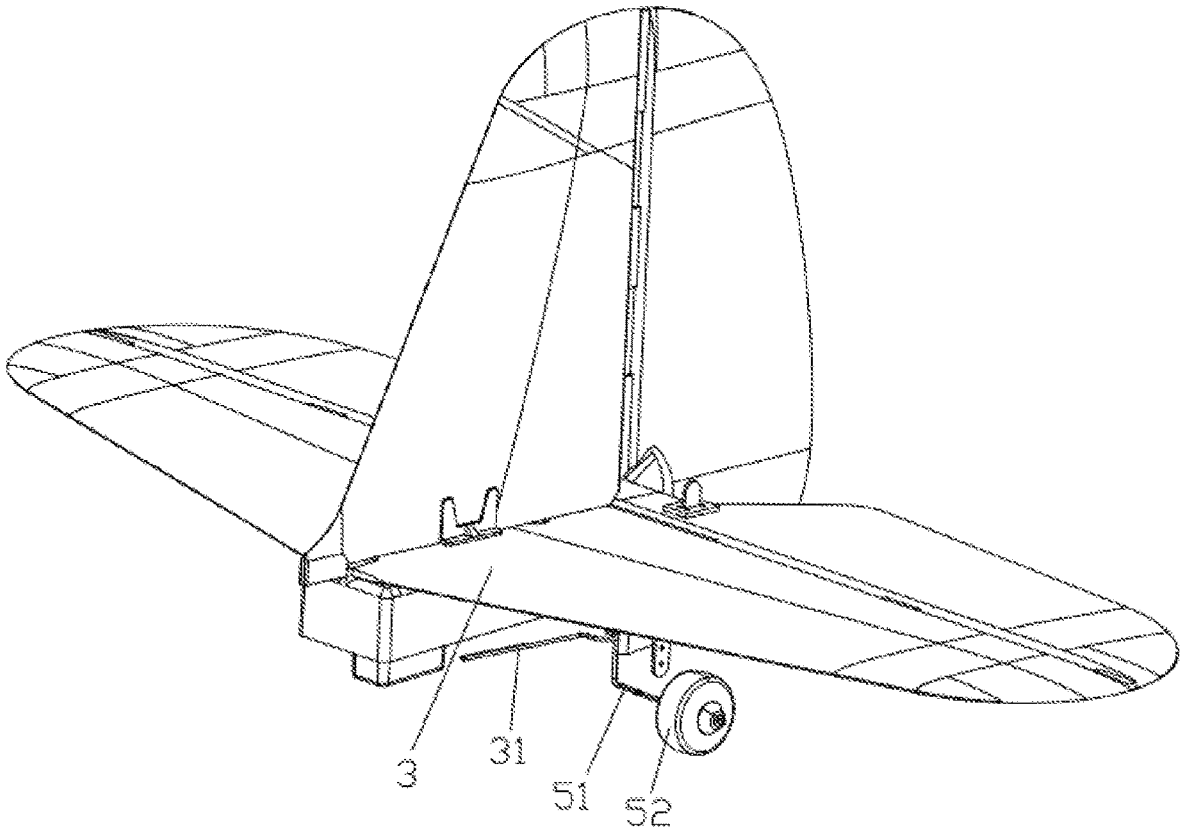
FIG. 7 is a schematic diagram of a rear wing according to an embodiment of the present disclosure.

Referring to FIG. 2 and FIG. 7, the aircraft body 1 is provided with a steering gear. One end of a steering gear connecting rod 15 is connected to the steering gear, and the other end of the steering gear connecting rod 15 extents toward the rear wing 3. The rear wing 3 is provided with a tail connecting rod 31. One end of the tail connecting rod 31 is connected with a transmission device in the rear wing 3, and the other end of the tail connecting rod 31 extends toward the steering gear connecting rod 15. The silicone hose 6 is elastic and has a hollow interior. The cooperating ends of the steering gear connecting rod 15 and the tail connecting rod 31 are both inserted into the silicone hose 6 and fixedly connected by interference fit. The silicone hose 6 can function as a coupling to transmit the torque of the steering gear to the transmission device in the rear wing 3 through the steering gear connecting rod 15, the silicone hose 6 and the tail connecting rod 31. It should be noted that, since the steering gear connecting rod 15, the tail connecting rod 31 and the silicone hose 6 are connected by interference fit, the steering gear connecting rod 15 and the tail connecting rod 31 can be inserted into or pulled out of the silicone hose 6 directly by a user, thus the assembly and disassembly of these three parts are extremely convenient, and the portability and maintenance of the three parts is also very convenient.

Figure 3:
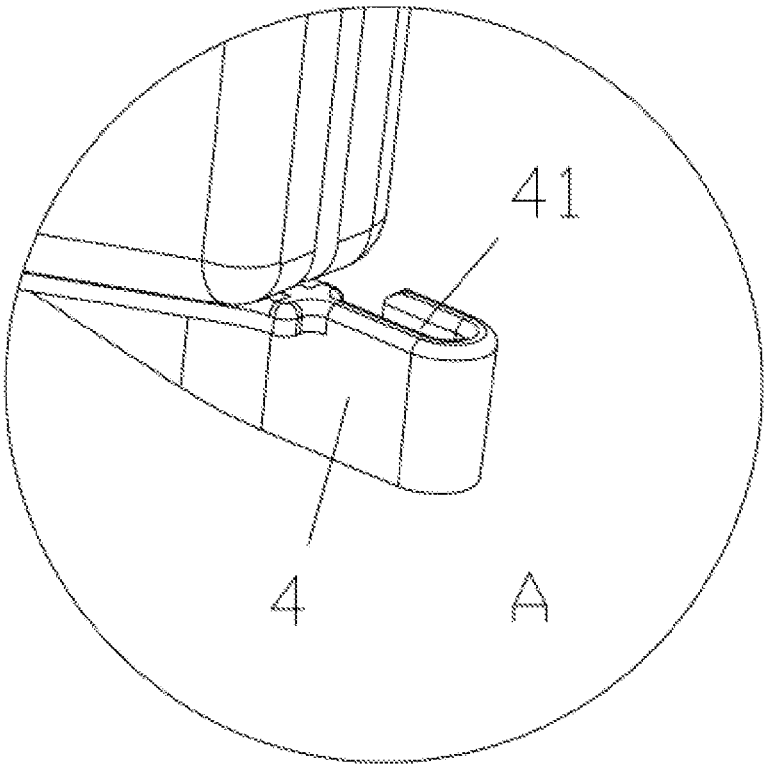
FIG. 3 is an enlarged diagram of part A in FIG. 2.

Referring to FIG. 3 and FIG. 7, a buffer bracket 4 is fixedly arranged on the lower side of the tail of the aircraft body 1, and a through groove 41 is formed by bending at the end of the buffer bracket 4 close to the rear wing 3.

The axle 51 includes a first rod and a second rod connected at an angle. One end of the first rod, which is away from the second rod, passes through the through groove 41 to be connected with the transmission device in the rear wing 3. One end of the second rod, which is away from the first rod, is rotationally connected with the tail wheel 52. When the remote-control aircraft lands, the tail wheel 52 will be in contact with the ground to generate upward pressure. Because of the angle between the first rod and the second rod, the tail wheel 52 firstly drives the second rod to move upward, and then the second rod abuts against the lower side surface of the buffer bracket 4 and stops moving upward. Therefore, the buffer bracket 4 can play a buffering role to prevent the tail wheel 52 from driving the axle 51 to move upward continuously and prevent the damage to the rear wing 3.

It should be understood that, firstly, disassembly, assembly and maintenance of the rear wing 3 and the aircraft body 1 can be easily achieved due to their modular design. Secondly, it can also reduce the difficulty for beginners to self-learn aviation model equipment, thus reducing product loss and increasing the utilization rate.

Figure 8:
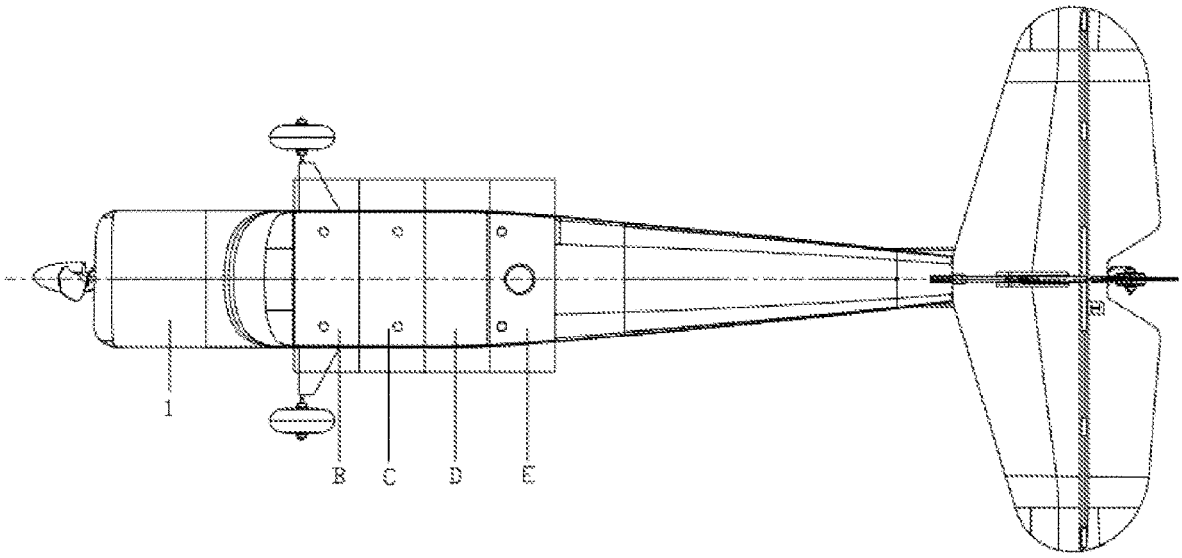
FIG. 8 is a schematic diagram of four areas of an aircraft body according to an embodiment of the present disclosure.

Referring to FIG. 8, it should be noted that, since the position of the connecting hole 14 relative to the aircraft body 1 has a greater influence on the flight of the remote-control aircraft, the present disclosure further provides four experiments for verification the optimal position of the connecting hole 14 relative to the aircraft body 1. Due to the cooperated arrangement of the inserting part 21 and the connecting hole 14, it can also verify the optimal position of the inserting part 21 relative to the aircraft wing 2.

Specifically, the installation platform 11 is divided into four adjacent areas, which are marked as a first area B, a second area C, a third area D and a fourth area E, respectively.

Figure 9:
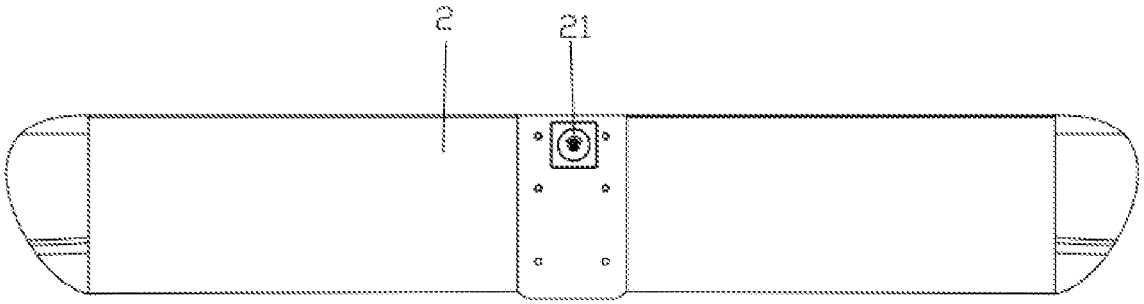
FIG. 9 is a schematic diagram of an aircraft wing in Experiment one according to an embodiment of the present disclosure.

Experiment one: the connecting hole 14 and the inserting part 21 are arranged in the first area B, conducting multiple flight experiments. The conclusion of Experiment one is as follows:

1. The location of the connecting hole 14 is near the center of gravity of the remote-control aircraft. The weights of the connecting part 12 and the inserting part 21 slightly affect the center of gravity of the remote-control aircraft, but do not affect the flight of the remote-control aircraft, thus the connecting hole 14 located in the first area B meets the functional requirements;
2. According to factors such as the angle of attack and the center of gravity of the aircraft wing 2, the position with maximum lift of the remote-control aircraft is at a front end of the aircraft wing 2. The aircraft wing 2 is subjected to a certain impact force during the flying of the remote-control aircraft, which causes the remote-control aircraft to stall and crash. The connecting hole 14 and the inserting part 21 located in the first area B can ensure that the aircraft body 1 and the aircraft wing 2 are not separated when falling, and thus meet the functional requirements;
3. Both the aircraft body 1 and the aircraft wing 2 are formed by the foaming of EPS sheets or EPS particles, causing that the firmness of the remote-control aircraft is not high, so the structural strength needs to be considered for the position of the inserting part 21. While the connecting hole 14 and the inserting part 21 are located in the first area B, the position of the inserting part 21 relative to the wing 2 is shown in FIG. 9, and the inserting part 21 is located in a front edge of the aircraft wing 2. After the aircraft wing 2 and the aircraft body 1 are repeatedly disassembled and assembled, the aircraft wing 2 can be easily broken. Therefore, the connecting holes 14 and the inserting part 21 located in the first area B do not meet the functional requirements.

Experiment two: the connecting hole 14 and the inserting part 21 are arranged in the second area C, conducting multiple flight experiments. The conclusion of Experiment two is as follows:

1. The location of the connecting hole 14 overlaps or nearly overlaps with the center of gravity of the remote-control aircraft. The weights of the connecting part 12 and the inserting part 21 do not affect the center of gravity of the remote-control aircraft and do not affect the flight of the remote-control aircraft, so the connecting hole 14 located in the second area C meets the functional requirements;
2. According to factors such as the angle of attack and the center of gravity of the aircraft wing 2, the position with maximum lift of the remote-control aircraft is at the front end of the aircraft wing 2. The aircraft wing 2 is subjected to a certain impact force during the flying of the remote-control aircraft, which causes the remote-control aircraft to stall and crash. The connecting hole 14 and the inserting part 21 located in the second area C can ensure that the aircraft body 1 and the aircraft wing 2 are not separated when falling, and thus meet the functional requirements;
3. Both the aircraft body 1 and the aircraft wing 2 are form by foaming of EPS sheets or EPS particles, causing that the firmness of the remote-control aircraft is not high, so the structural strength needs to be considered for the position of the inserting part 21. Since the connecting hole 14 and the inserting part 21 are located in the second area C, after the aircraft wing 2 and the aircraft body 1 are repeatedly disassembled and assembled, the aircraft wing 2 is not easily broken. Therefore, the connecting holes 14 and the inserting part 21 located in the second area C meet the functional requirements.

Experiment three: the connecting hole 14 and the inserting part 21 are arranged in the third area D, conducting multiple flight experiments. The conclusion of Experiment three is as follows:

1. A certain distance is between the location of the connecting hole 14 and the center of gravity of the remote-control aircraft. The weights of the connecting part 12 and the inserting part 21 can affect the center of gravity of the remote-control aircraft and slightly affect the flight of the remote-control aircraft, so the connecting hole 14 located in the third area D does not meet the functional requirements;
2. According to factors such as the angle of attack and the center of gravity of the aircraft wing 2, the position with maximum lift of the remote-control aircraft is at the front end of the aircraft wing 2. The aircraft wing 2 is subjected to a certain impact force during the flying of the remote-control aircraft, which causes the remote-control aircraft to stall and crash. The connecting hole 14 and the inserting part 21 located in the third area D do not ensure that the aircraft body 1 and the aircraft wing 2 are not separated when falling, and thus do not meet the functional requirements;
3. Both the aircraft body 1 and the aircraft wing 2 are formed by foaming of EPS sheets or EPS particles, causing that the firmness of the remote-control aircraft is not high, so the structural strength needs to be considered for the position of the inserting part 21. Since the connecting hole 14 and the inserting part 21 are located in the third area D, after the aircraft wing 2 and the aircraft body 1 are repeatedly disassembled and assembled, the aircraft wing 2 is not easily broken. Therefore, the connecting holes 14 and the inserting part 21 located in the third area D meet the functional requirements.

Figure 10:
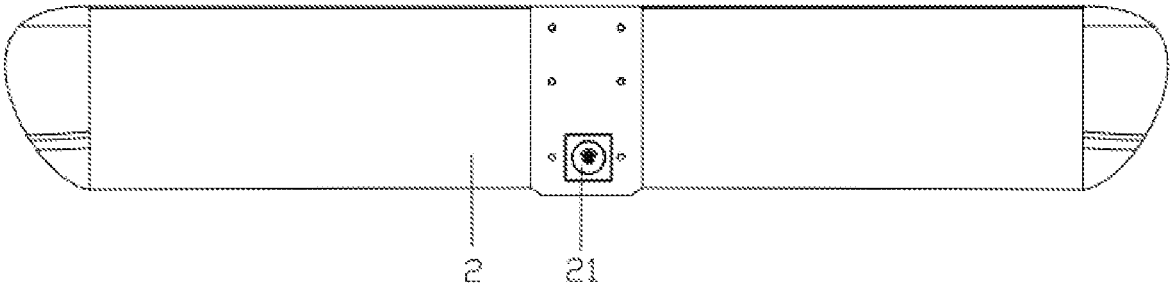
FIG. 10 is a schematic diagram of an aircraft wing in Experiment four according to an embodiment of the present disclosure.

Experiment four: the connecting hole 14 and the inserting part 21 are arranged in the fourth area E, conducting multiple flight experiments. The conclusion of Experiment four is as follows:

1. The distance between the connecting hole 14 and the center of gravity of the remote-control aircraft is relatively large. The weights of the connecting part 12 and the inserting part 21 can affect the center of gravity of the remote-control aircraft and affect the flight of the remote-control aircraft, so the connecting hole 14 located in the fourth area E does not meet the functional requirements;
2. According to factors such as the angle of attack and the center of gravity of the aircraft wing 2, the position with maximum lift of the remote-control aircraft is at the front end of the aircraft wing 2. The aircraft wing 2 is subjected to a certain impact force during the flying of the remote-control aircraft, which causes the remote-control aircraft to stall and crash. The connecting hole 14 and the inserting part 21 located in the fourth area E do not ensure that the aircraft body 1 and the aircraft wing 2 are not separated when falling, and thus do not meet the functional requirements;
3. Both the aircraft body 1 and the aircraft wing 2 are formed by foaming of EPS sheets or EPS particles, causing that the firmness of the remote-control aircraft is not high, so the structural strength needs to be considered for the position of the inserting part 21. While the connecting hole 14 and the inserting part 21 are located in the fourth area E, the position of the inserting part 21 relative to the wing 2 is shown in FIG. 10, and the inserting part 21 is located in the rear edge of the aircraft wing 2. After the aircraft wing 2 and the aircraft body 1 are repeatedly disassembled and assembled, the aircraft wing 2 can be easily broken. Therefore, the connecting holes 14 and the inserting part 21 located in the fourth area E do not meet the functional requirements.

Based on the four experiments, when the connecting hole 14 and the inserting part 21 are arranged in the second area C, the weights of the connecting part 12 and the inserting part 21 will not affect the center of gravity of the remote-control aircraft. When the aircraft wing 2 is subjected to a certain impact force, it can ensure that the aircraft body 1 and the aircraft wing 2 are not separated. After the aircraft wing 2 and the aircraft body 1 are repeatedly disassembled and assembled, the aircraft wing 2 can not be easily broken.

Those skilled in the art should understand that, the technical features of the above embodiments can be arbitrarily combined. In an effort to provide a concise description, not all possible combinations of all the technical features of the embodiments are described. However, these combinations of technical features should be construed as disclosed in the description as long as no contradiction occurs.

The above embodiments are merely illustrative of several implementation manners of the present disclosure, and the description thereof is more specific and detailed, but is not to be construed as a limitation to the patentable scope of the present disclosure. It should be pointed out that several variations and improvements can be made by those of ordinary skill in the art without departing from the conception of the present disclosure, but such variations and improvements should fall within the protection scope of the present disclosure. Therefore, the protection scope of the present disclosure should be subject to the protection scope defined by the claims.

What is claimed is:

1. A remote-control aircraft, comprising:

an aircraft body provided with a mounting platform, the mounting platform being provided with a connecting part and at least one first magnet, the connecting part being perforated with a connecting hole, the connecting hole overlapping or nearly overlapping with a center of gravity of the remote-control aircraft;

an aircraft wing provided with a inserting part and at least one second magnet on a lower side of the aircraft wing close to the aircraft body, the inserting part being rotationally inserted into the connecting hole so that the aircraft wing is rotatable relative to the aircraft body when colliding with an obstacle, the at least one second magnet and the at least one first magnet are connected by magnetic attraction so that the aircraft wing is in close contact with the mounting platform;

a rear wing fixed to a tail of the aircraft body, wherein the inserting part comprises a mounting plate and two inserting connectors, one end of each inserting connector is fixedly connected to the mounting plate, the two inserting connectors are arranged at intervals, and side surfaces of the two inserting connectors away from each other are arc surfaces and are respectively provided with buckles, each buckle extends along a circumferential direction of the corresponding inserting connector, and wherein the rear wing comprises a tail connecting rod, the aircraft body further comprises a steering gear connecting rod, and the remote-control aircraft further comprises a silicone hose, and the cooperating ends of the tail connecting rod and the steering gear connecting rod are both inserted into the silicone hose and fixedly connected by interference fit.

2. The remote-control aircraft according to claim 1, wherein the diameter between the two buckles is larger than a diameter of the connecting hole.

3. The remote-control aircraft according to claim 2, wherein the buckles along with the inserting connectors pass through the connecting hole, and the buckles and the connecting part are arranged with certain space after installation.

4. The remote-control aircraft according to claim 2, wherein both an upper surface and a lower surface of each buckle are arc surfaces.

5. The remote-control aircraft according to claim 1, wherein the number of the at least one first magnet is six, and three of the first magnets and the other three of the first magnets are arranged symmetrically with respect to a center line of the aircraft body; and, the number of the at least one second magnet is six, and each second magnet is arranged in a one-to-one correspondence with the first magnet.

6. The remote-control aircraft according to claim 1, wherein the number of the at least one first magnet is six, and four of the first magnets are arranged on the mounting platform close to an aircraft nose, and the other two of the first magnets are arranged on the mounting platform close to an aircraft tail.

7. The remote-control aircraft according to claim 1, wherein the rear wing is fixed to the tail of the aircraft body by adhesive connection.

8. The remote-control aircraft according to claim 7, further comprising a buffer bracket, an axle and a tail wheel, the buffer bracket being fixedly arranged on a lower side of the tail of the aircraft body, a through groove being provided on the buffer bracket, the axle comprising a first rod and a second rod connected to the first rod at an angle, one end of the first rod passing through the through groove to be connected with the rear wing, and one end of the second rod away from the first rod being rotationally connected with the tail wheel.

* * * * *